US005373987A

United States Patent [19]

Corabatir

[11] Patent Number: 5,373,987

[45] Date of Patent: Dec. 20, 1994

[54] VARIABLE VOLUME AIR VALVE

[76] Inventor: Kaya Corabatir, 103 Wild Briarway, Willowdale, Ontario M2J 2L5, Canada

[21] Appl. No.: 152,123

[22] Filed: Nov. 16, 1993

[51] Int. Cl.[5] ..... F24F 13/10

[52] U.S. Cl. ..... 236/49.3; 74/424.8 VA; 251/129.12

[58] Field of Search ..... 236/49.3, 49.4, 49.5; 74/424.8 VA; 251/129.12, 264, 274

[56] References Cited

U.S. PATENT DOCUMENTS

| | | | |
|---|---|---|---|
| Re. 29,280 | 6/1977 | McNabney | 236/49.3 X |
| 4,068,799 | 1/1978 | Brodin | 236/49.3 |
| 4,121,762 | 10/1978 | Modes | 236/49.4 |
| 4,177,970 | 12/1979 | Ring, Jr. | 236/49.5 X |
| 4,283,008 | 8/1981 | Ring, Jr. | 236/49.4 |
| 4,848,653 | 7/1989 | Van Becelaere | 236/49.5 |

*Primary Examiner*—William E. Tapolcai

[57] ABSTRACT

An apparatus for temperature control in a room by adjusting supply air flow rate in response to a room thermostat in a ducted air conditioning system where a plurality of rooms are supplied by a single air handling unit. The apparatus may be installed in a plenum which is directly mounted on an air supply terminal. The apparatus is connected to a main supply duct with a branch duct, and as a result of its favorable geometry and throttling method, operates at low noise levels. The apparatus employs high aspect ratio converging nozzles to allow incoming air accelerate into a thin sheet of high velocity air stream. Air flow rate is adjusted simply by changing tile nozzle area. This high velocity air stream entrains surrounding air within the plenum and slows down. Its energy is dissipated through friction with acoustically lined plenum walls. In tiffs process, little noise generated. The apparatus, due to its special shape, allows accurate measurement of air flow rate. The apparatus incorporates a control system for adjusting the air flow rate in response to a room thermostat. The control system may further comprise means for controlling supplementary heaters or heating valves.

13 Claims, 9 Drawing Sheets

VARIABLE VOLUME AIR VALVE

This invention relates to a variable volume air valve which can be incorporated in a plenum directly attached to an air supply terminal in a heating, ventilation and air conditioning system.

BACKGROUND

Variable volume air conditioning systems are well known in tile industry and are commonly used in different kinds of buildings where zoning is required to maintain desired comfort conditions in a plurality of rooms that are served by a single air handling and air conditioning apparatus. The variable volume system and its variations are described in Chapter 2 of American Society of Heating, Refrigeration and Air Conditioning Engineers Inc. (ASHRAE) handbook; Heating, Ventilating and Air Conditioning Systems and Equipment, 1992 Edition. These systems comprise the following as the essential elements:

- an air handling and air conditioning apparatus;
- a main supply duct to convey conditioned air to the vicinity of the zones served by the air conditioning apparatus;
- a plurality of variable air volume (VAV) boxes comprising dampers and actuators, connected to the main supply duct via branches;
- distribution ductwork, connected to downstream of VAV boxes to convey conditioned air to a single or a plurality of air terminals located in each zone;
- provision for noise reduction in the form of acoustical duct lining of the distribution ductwork or a silencer downstream of each VAV box;
- A plurality of zone thermostats, one for each zone, located in one of the rooms within each zone; and
- An automatic control system for each VAV box, which may be pneumatic, electric, electronic or digital electronic, to respond signals from the zone thermostat and to reposition the damper in the VAV box, increasing or decreasing the air volume (air flow rate) into the zone. The control system may also receive and respond to signals from a building automation system. Additionally, it may also control reheat or perimeter heating apparatus.

The dampers in VAV boxes are generally round or rectangular single blade type, commonly referred to as butterfly dampers. Rectangular multi-blade dampers are used less commonly, due to their higher cost. When throttling to adjust air volume, these dampers reduce pressure by inducing geometric flow separation and turbulence in the air stream. Through lifts mechanism the total pressure is dissipated into heat. In the mean time, turbulence interaction with damper blades and duct walls and pressure perturbations with frequencies within audible range are perceived as noise by the occupants. The noise level, or more precisely the sound power level is a function of damper geometry, blade position, pressure drop across the damper and air flow rate. A method of predicting this damper noise is given in ASHRAE handbook; HVAC applications, 1991 edition. To attenuate this noise, silencers or acoustically lined distribution ductwork are usually employed downstream of the dampers.

To achieve the best possible temperature comfort, ideally each room should be made an independently controlled zone. However, due to the cost and impracticality of using a VAV box, acoustically lined ductwork or a silencer and distribution ductwork for each room, this is rarely done. The usual practice is to lump a number of rooms of similar cooling/heating characteristics into a single zone, and locate the zone thermostat in one of these rooms. However, there are always variations in room loads and occupants'preferences, therefore this grouping does not always work satisfactorily.

To avoid the compromise mentioned above, during the last few years, a different type of air terminal design has been developed, which incorporates a volume control damper within the air terminal itself, thus eliminates the VAV box. Air volume al each terminal can be controlled individually, therefore each room can be made an individual zone by installing a room thermostat to control the damper inside the air terminal. However, there are two major drawbacks associated with this scheme, as follows:

- The first drawback is related to the damper noise. In order to operate at acceptable noise levels, these systems must restrict the pressure drop across the damper within the air terminal (The higher the pressure drop across the damper, the higher the noise). A common method to accomplish this is to control the duct static pressure by means of a separate damper located in a branch duct serving a plurality of such terminals, modulated in response to downstream duct static pressure. The inlet pressure at the terminal is limited to about 60 Pascals. Thus the noise is kept within acceptable limits. Unfortunately, this solution introduces the additional cost and complexity of a pressure regulating damper, a pressure sensor, a control loop and acoustic treatment downstream of the pressure regulating damper.
- The second drawback is the difficulty in applying pressure independent controls. Incorporating an air velocity sensor into every branch serving such an air terminal is expensive and impractical, therefore presently systems using this type of terminals do not employ pressure independent controls. Pressure fluctuations at the terminal inlet result in changes in air flow rate, which in turn may cause temperature fluctuations in the room.

BRIEF SUMMARY OF THE INVENTION

I have found that, the two major drawbacks mentioned above can be overcome by a new variable volume air valve that does not create appreciable turbulence, thus generates little noise. This air valve can be used well above 60 Pascals inlet static pressure, eliminating the need for upstream pressure regulation and sound attenuation in most applications. Further, due to its unique shape and method of operation, which will be described in full detail below, the air flow rate through the variable air valve can be measured easily and accurately by measuring the differential pressure at the inlet and outlet of the variable volume air valve and using the valve position input.

The operating principle of the invention can be summarized as follows: The variable volume air valve receives supply air from a main supply duct, and directs the air into an acoustically lined plenum through at least one converging nozzle. The nozzle has a very high aspect ratio (length versus width), and the inflowing air flow is accelerated into a thin sheet of high velocity stream. In accordance with the flow theory, the air velocity at the tip of the nozzle is proportional to the square root of pressure difference between inlet of the variable volume air valve and inside of the plenum. The high velocity air stream discharging from the nozzle rapidly entrains the surrounding air inside the plenum, and its velocity drops considerably within a short distance from the tip of the nozzle. The kinetic energy of the slower but larger mass of the primary and the entrained air is quickly dissipated through friction with acoustically lined plenum walls. The air then flows into the room through a supply terminal attached to the plenum. During the entire process, minimum turbulence, therefore minimum noise is generated. Baffle plates, with or without acoustic lining may be used inside the plenum to promote friction and further attenuate any noise generated at the nozzle. For a given static pressure in the supply duct, the air flow into the plenum can be adjusted very linearly by changing the width, thus the area of the nozzle.

DETAILED DESCRIPTION

The invention will now be described in detail in reference to the drawings briefly described above.

Figure 1:
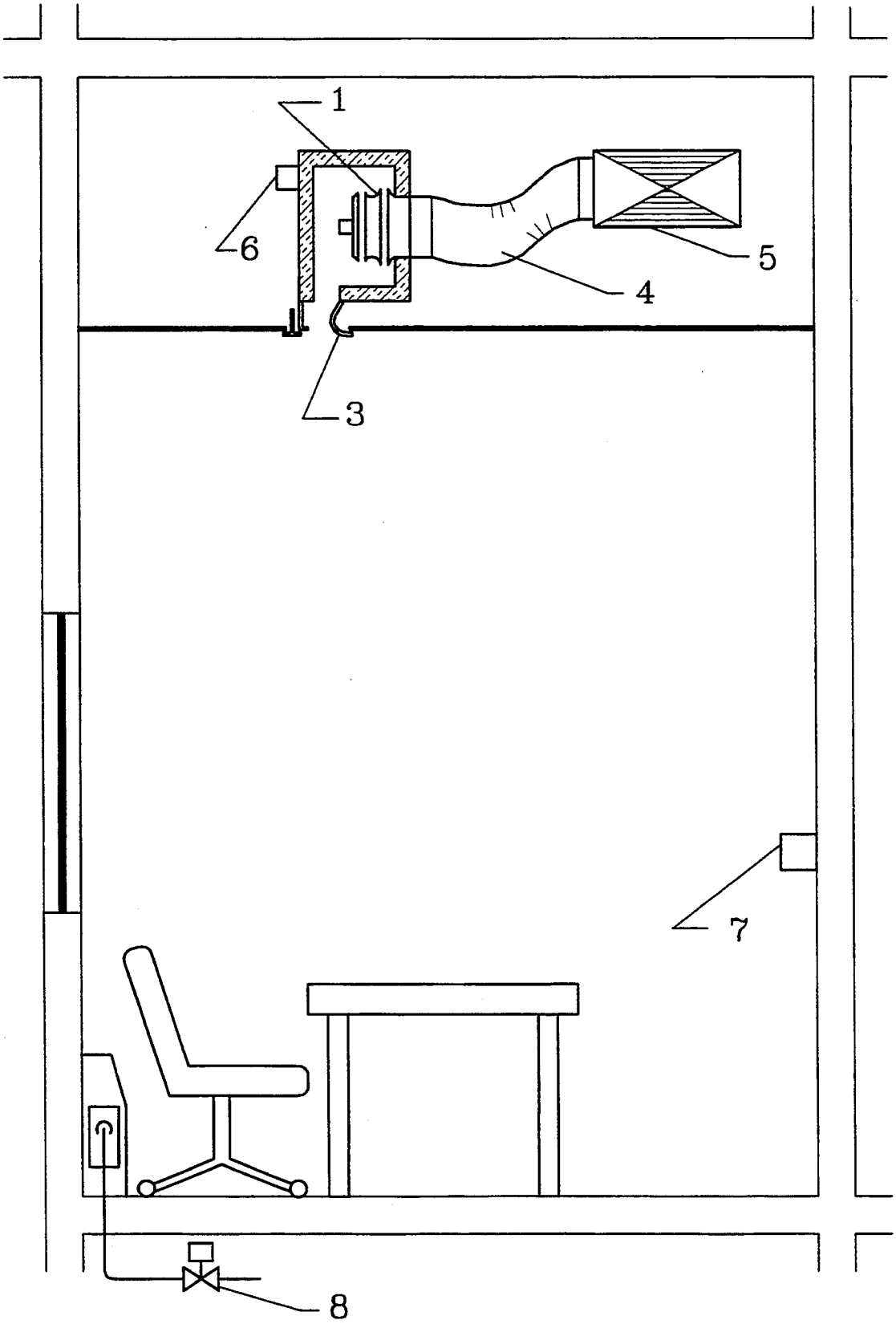
FIG. 1 is a combined elevation and section showing a typical supply air duct, an air terminal, and a thermostat arrangement using the invention in a heating, ventilation, air conditioning system.

In reference to FIG. 1, the preferred embodiment of the variable volume air valve 1 is installed in a plenum 2 which is directly on top of, and attached to a supply air terminal 3. The air terminal can be a linear slot diffuser, a square or a round diffuser, or any suitable diffuser. A branch duct 4, preferably a piece of flexible duct connects the variable volume air valve 1 to a supply duct 5. An electronic controller is located in a control box 6 attached to the plenum. The electronic controller features one or more microcontrollers which communicate with the room thermostat 7, a building automation system and control the variable volume air valve 1 and perimeter heating valve 8. Preferred communication medium is a single pair of twisted wire, although other media such as coaxial cable, fibre optic cable, even electromagnetic waves can be employed. The control box requires a power supply, which is not shown for sake of simplicity.

Figure 2:
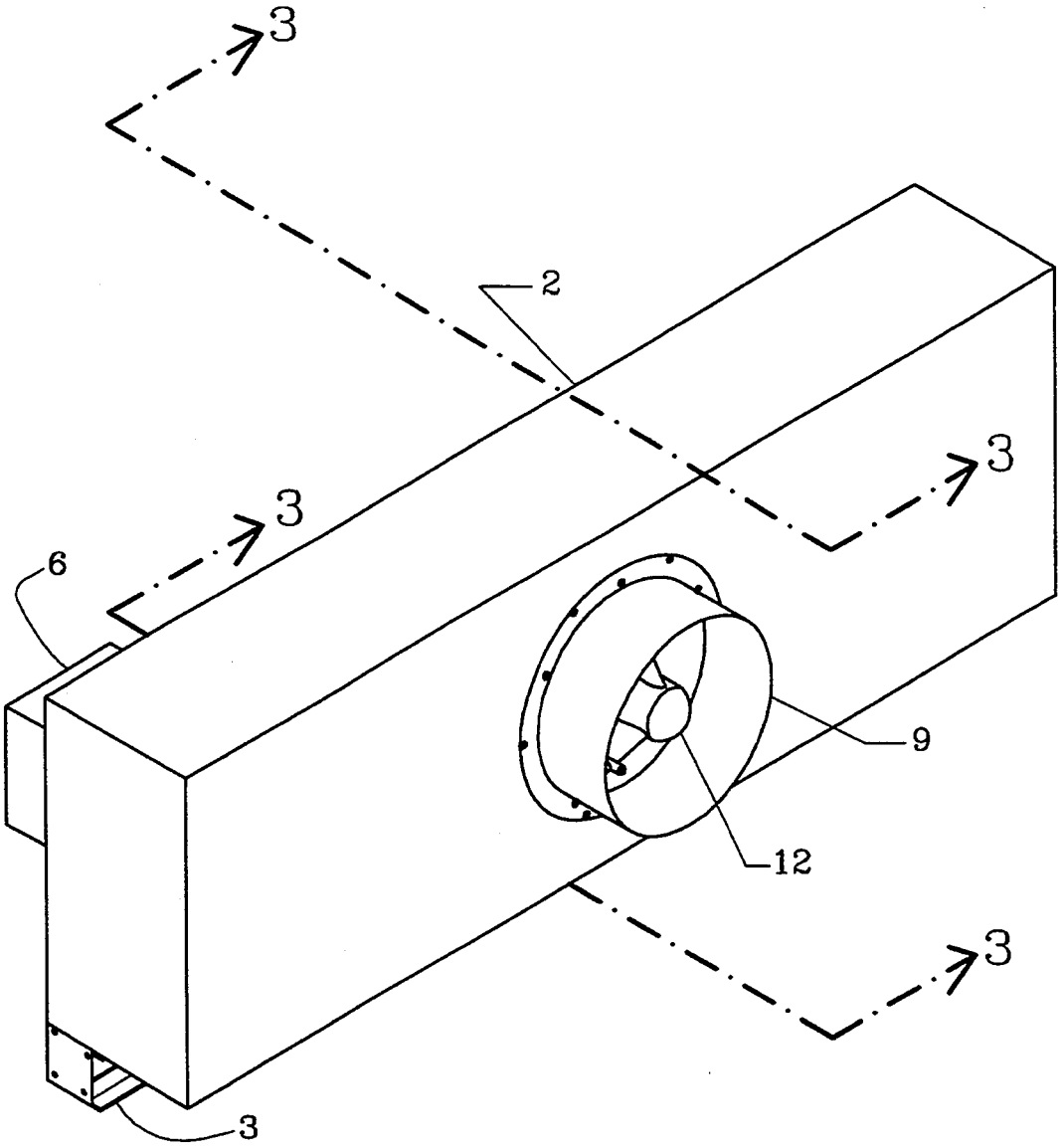
FIG. 2 is an isometric view of the variable air valve, its plenum and the supply air terminal as an assembly.

In reference to FIG. 2, the variable volume air valve 1 is shown in its plenum 2 which is attached to a linear supply air terminal 3. The supply air terminal may be supported by the T-bars of the suspended ceiling. The plenum may further be supported from the building structure. A duct collar 9 is connected to a branch duct 4 as shown in FIG. 1. In reference to FIG. 3, the variable volume air valve 1 comprises four major components; an inlet ring 10, a main shaft 13, a middle ring 14 and an end plate 19 with gear and motor housing 22. The inlet ring 10 which ultimately supports all other components of the variable air valve 1 is rigidly attached to and supported by the duct collar 9. The duct collar itself is attached removably to the plenum 2 by fasteners, such as sheet metal screws. In this fashion the variable volume air valve 1 may be quickly removed from the plenum 2 for inspection and servicing. The inlet ring 10 has a minimum of two, preferably three spokes 11 and a hollow hub 12. The upstream end of the main shaft 13, relative to the air flow direction indicated by arrows, is rigidly attached to the hub 12 of the inlet ring 10, and does not rotate. The middle ring, comprising a minimum of two, preferably three spokes 15, a hub 16 and a sleeve 17 is mounted on the main shaft 13 and is free to slide along the main shaft 13. The sleeve 17 is made of a material with low coefficient of friction, such as filled plastic. A compression spring 18 pushes the middle ring 14 away from the inlet ring 10. The end plate 19 comprising a motor and gear housing 22 and a sleeve 20 made of a low friction material is mounted on the main shaft 13, downstream of the middle ring 14. An additional compression spring 21 pushes the end plate 19 away from the middle ring 14 so that, provided the two compression springs 18, 21 are of equal length and spring constant, the middle ring 14 will always automatically assume a halfway position between the inlet ring 10 and the end plate 19.

Figure 5:
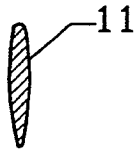
FIG. 5 shows a cross-section of one of the spokes of the inlet ring along the section line 5—5.
Figure 6:
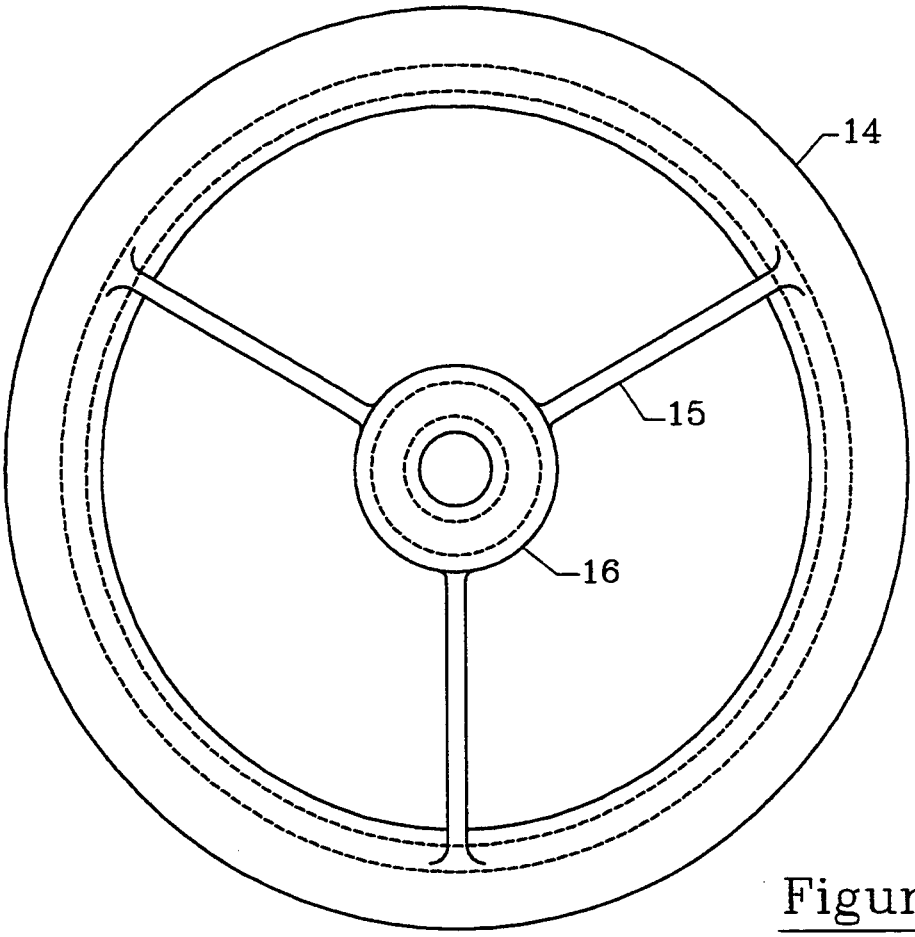
FIG. 6 is a front view of the middle ring.
Figure 7:
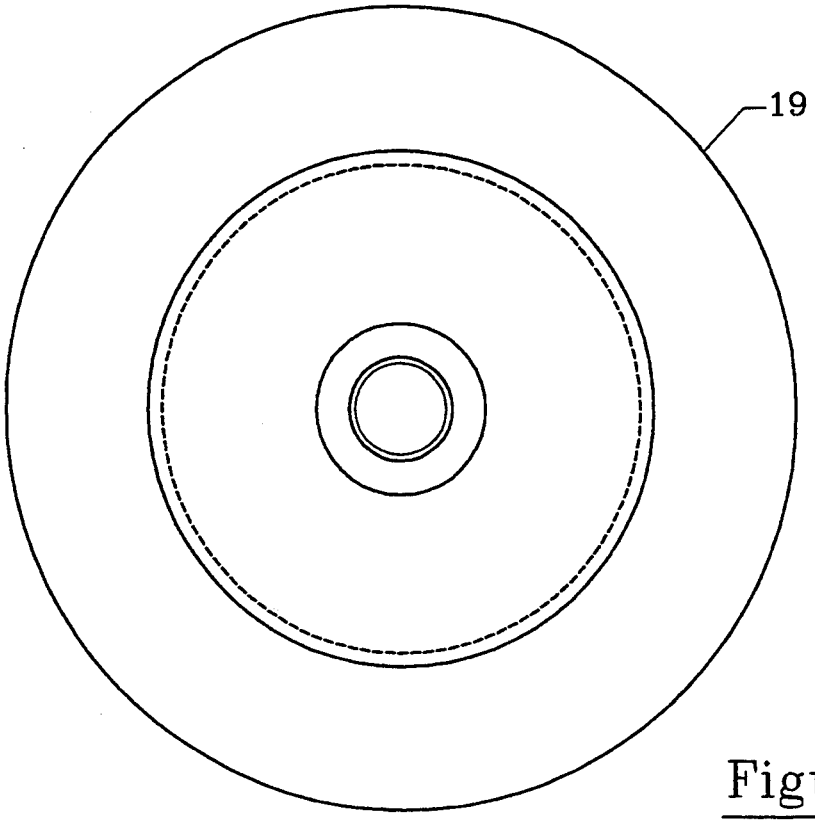
FIG. 7 is a front view of the end plate.

The spokes 11 of the inlet ring 10 and the middle ring have an airfoil cross-section, as shown in FIG. 5, to reduce pressure drop and minimize creation of turbulence.

Figure 3:
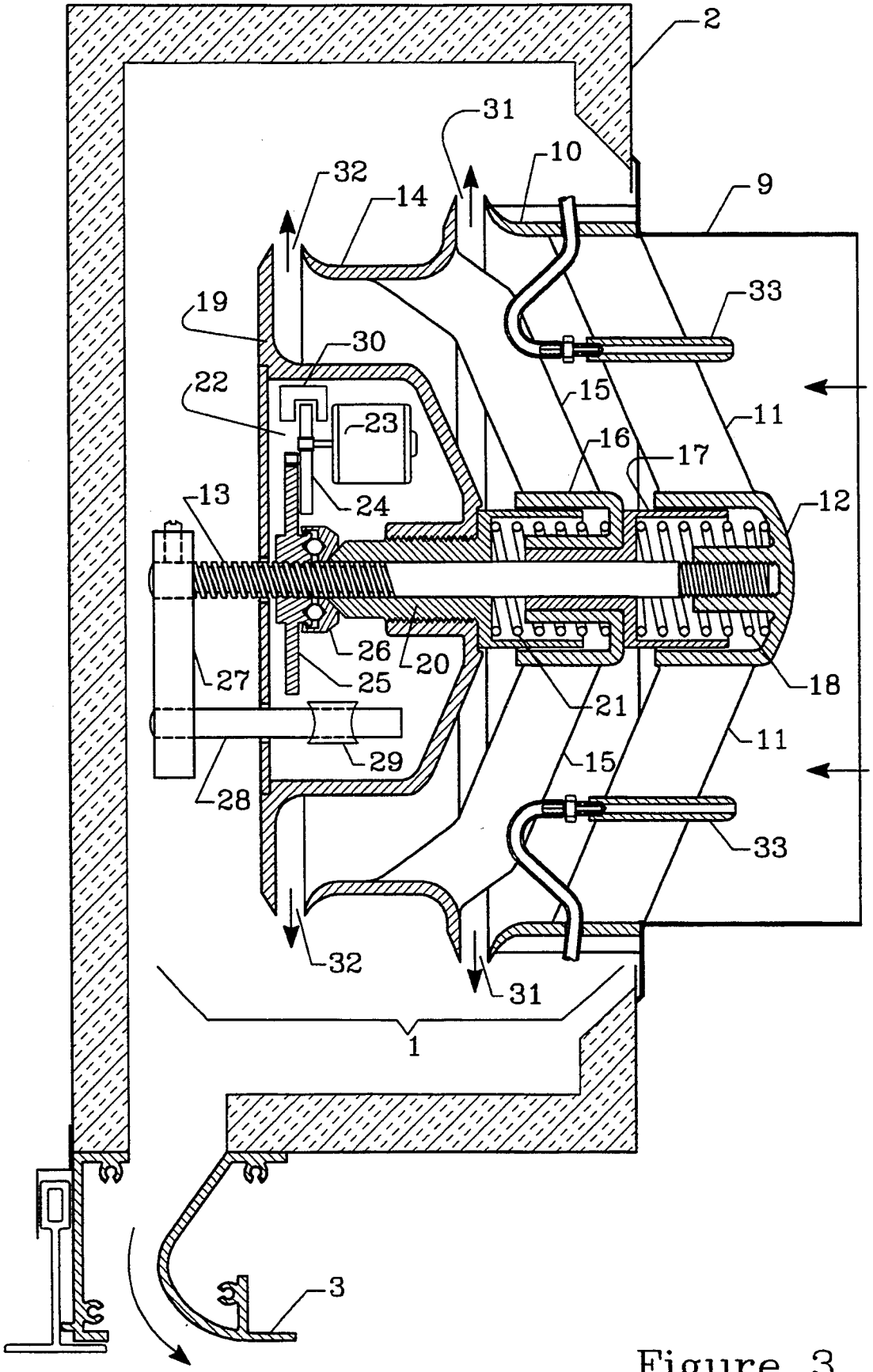
FIG. 3 is a section through the preferred embodiment and its plenum along the section line 3—3.
Figure 4:
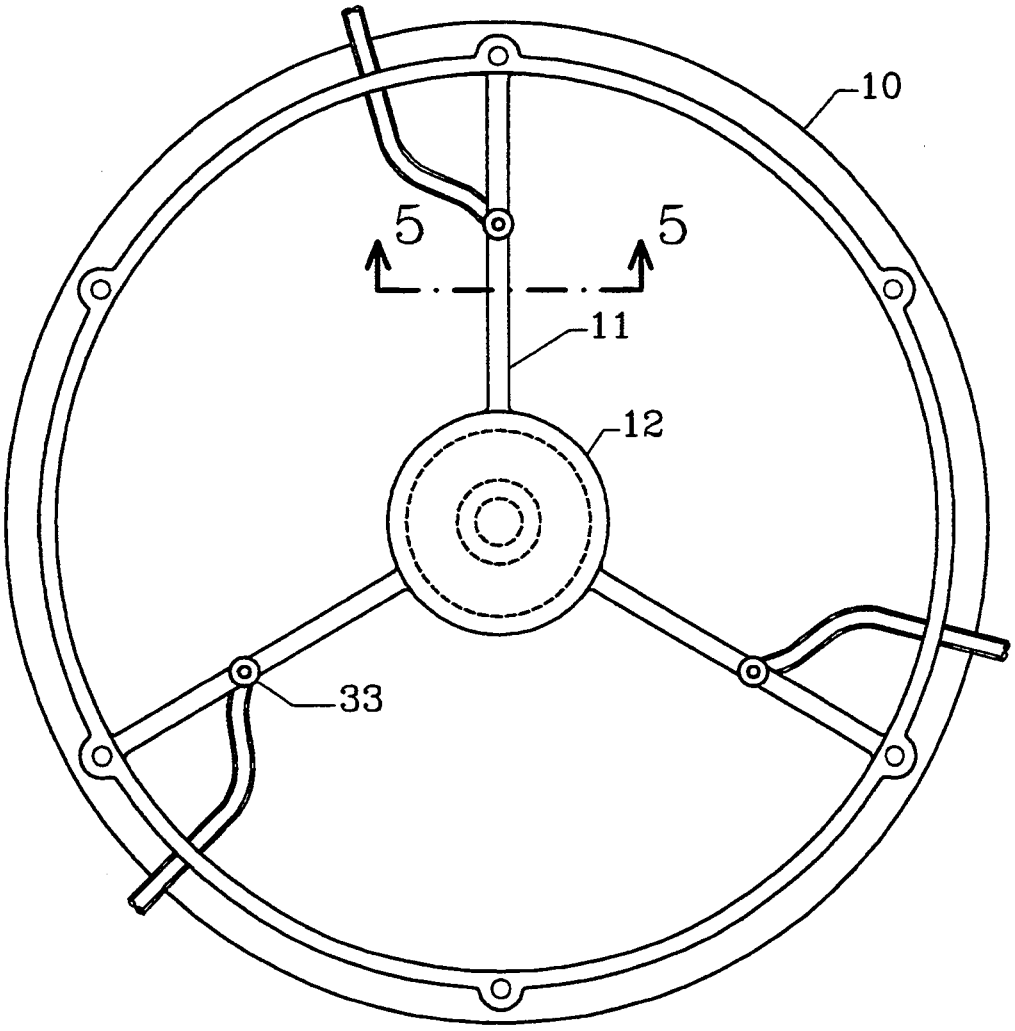
FIG. 4 is a front view of the inlet ring of the variable air valve with respect to air flow direction.

In reference to FIG. 3, the downstream end of the main shaft 13 with respect to air flow direction is screw threaded. The motor and gear housing 22 contains an electric motor 23, a reduction gear train 24 and a captive nut 25 which is also the last driven gear in the gear train. The captive nut 25 is in contact with the sleeve 20 of the end plate through a thrust ball bearing 26 and thus limits the movement of the end plate 19 towards the downstream end of the main shaft 13 under the spring force. The captive nut 25 rides along the main shaft 13 when rotated by the motor 23 and the gear train 24 and thus moves the end plate 19 towards or away from the inlet ring 10 depending on the direction of rotation. The end plate 19, and the motor and gear housing 22 are prevented from rotating about the main shaft 13 axis due to the gear reaction force by a torque arm 27, and a shorter torque shaft 28 and the two rollers 29. One end of the torque arm 27 is rigidly attached to the downstream end of the main shaft 13 whereas the other end rigidly supports the torque shall 28, which is parallel to the main shaft 13. The two rollers 29 are located within the motor and gear housing 22, their axis being in a plane vertical to the main shaft 13 axis. The rollers 29 are rotatably attached to the motor and gear housing 22 and ride along the torque shaft 28 as the end plate 19 moves relative to the main shaft 13, transferring the gear reaction force to the torque shaft 28.

A position sensing device 30, such as a optical encoder or a hall effect revolution counter, is located within the motor and gear housing 22 and provides an input liar the electronic controller indicative of the position of the end plate relative to the main shaft 13, thus also indicative of the width of the nozzles 31, 32 that form between the rims of the inlet ring 10 and the middle ring 14 and between the rims of the middle ring 14 and the end plate 19 respectively.

The thrust ball bearing 26 has V shaped grooves and is always loaded by the force of the compression springs 18, 21. These V-grooves and the spring force help align the axis of the end plate with the axis of the captive nut 25.

Operating principle of the air valve is as follows: In reference to FIG. 3, the rims of the inlet ring 10, the middle ring 14 and the end plate 19 form two converging nozzles 31, 32 through which air flows into the plenum in a radial direction relative to the axis of the main shaft 13. The static pressure is converted into velocity pressure as the entering air is accelerated to a theoretical final velocity which may be calculated according to the following formula given in ASHRAE Handbook, Fundamentals, 1993 for standard air at 1.204 kg/m$^3$ density:

$$V = \sqrt{\frac{P}{0.602}}$$

Where V is the velocity of air leaving the nozzle in m/s and P is the velocity pressure in Pascals, which is equal to the total pressure difference between the inlet and a point inside the plenum, assuming negligible pressure loss in the nozzle itself. Static pressure regain is also negligible due to the shape of the nozzles. The nozzles 31, 32 have very high aspect ratio (Length versus width), especially when the end plate 19 is moved closer to the inlet ring 10. The thin sheet of air flowing through the nozzles 31, 32 rapidly entrains the surrounding air, and within a short distance, the flow velocity is reduced to a fraction of the velocity at the tip of the nozzle. The kinetic energy of the air stream, on the other hand, remains about the same, since it has been transferred to a much larger mass of air moving at a slower speed. However, this energy can be quickly dissipated through friction with the acoustically lined plenum 2 walls. There is no part located in the high velocity air stream to create turbulence, thus noise. Any turbulence created in the slower moving air stream is much less severe, and so is the resulting noise. The nozzles 31, 32 are deliberately positioned away from the plenum 2 walls to prevent impingement of flow on the walls, thereby reducing its capacity to entrain surrounding air.

The air flow rate through the variable volume air valve can be measured and calculated by the electronic controller as follows: A pressure sensor located in the control box 6 sends a signal corresponding to the pressure difference between its high pressure port and the low pressure port. The high pressure port is connected to the total pressure probes 33 that are attached to, or form a part of the inlet ring 10. The low pressure port opens to a corner of the plenum where the air velocity is low. The electronic controller keeps track of the position of the end plate 19 by counting motor 23 or gear 24 revolutions in each direction of rotation, therefore it "knows" the nozzle width, thus nozzle area of the nozzles 31, 32. From the differential pressure signal, the air velocity is calculated according to the formula given above. Flow area multiplied by flow velocity gives the air flow rate.

Since the differential pressure is measured across the nozzles 31, 32, the signal level is always higher compared to a differential pressure signal that can be obtained by a pitot tube or impact probe located in the branch duct serving the plenum. This is because the nozzle area is much smaller compared to the branch duct cross sectional area where the pitot tube or impact tube would normally be installed. Further, as the variable volume air valve throttles, the air velocity in the branch duct decreases, and the pitot tube or impact probe signal would decrease too, whereas the differential pressure signal across the nozzles will not change as long as the inlet pressure does not change. This higher signal level allows more accurate measurements, or alternatively, less sensitive therefore less expensive pressure sensors may be employed for the same air flow rate measurement accuracy.

During the cooling mode, in reference to FIG. 1, the room thermostat 7 sends a signal corresponding to actual room temperature, and an error signal corresponding to the difference between its set point and the actual room temperature. The electronic controller compares the error signal with a previously received error signal, and calculates the error change. Using the error signal and the error change, the controller calculates the required correction to the present air flow rate, then repositions the end plate 19 to obtain the new air flow rate. The control action is essentially proportional-integral type.

A temperature sensor within the plenum 2 monitors the supply air temperature. If the supply air temperature is higher than the room temperature, heating mode is automatically selected, and control action of the variable volume air valve is reversed. If the room temperature set point cannot be maintained at the maximum allowed flow rate, a reheat or perimeter heating system, if there is one, is activated and controlled by the signals from the electronic controller.

Building operators can communicate with the air valve electronic controller through the building automation system to set maximum, minimum allowable air flow rates, and to read current air flow rate. Another method is to plug in a portable computer or a similar instrument into the room thermostat and communicate with the air valve controller.

Figure 8:
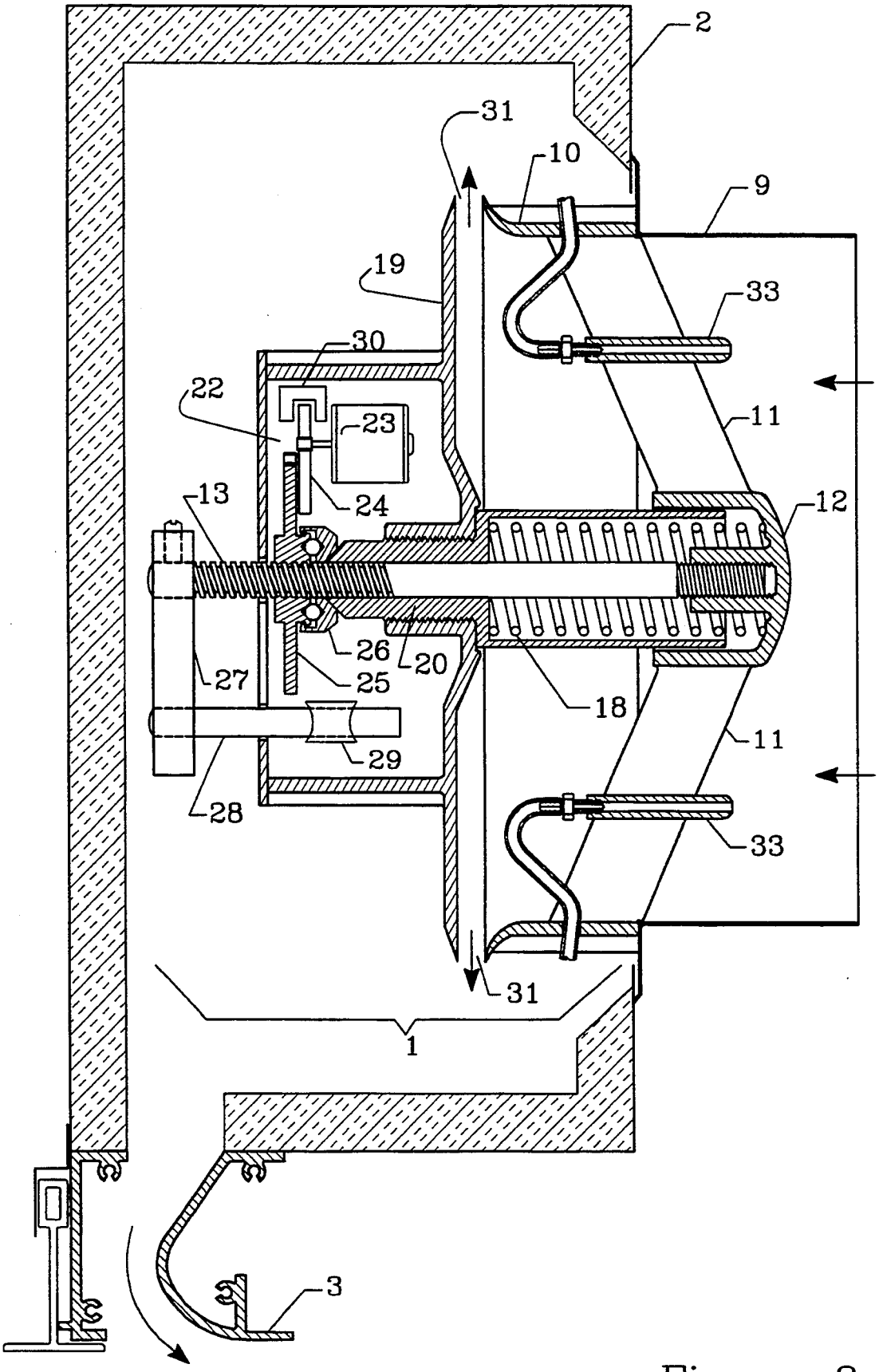
FIG. 8 is a section through a second embodiment of the invention wherein the middle ring is omitted to save cost.

It should be understood that file scope of tiffs invention is not limited to the specific geometrical shape illustrated in FIGS. 3, 4, 5, 6 and 7. To reduce manufacturing costs, the middle ring 14, its sleeve 17 and one of the compression springs 21 may be omitted. This second embodiment of the air valve is illustrated in FIG. 8. The result of this modification is reduced nozzle aspect ratio, longer distance for equivalent air flow velocity reduction, and higher operating noise, which may be tolerated in less critical applications, or in systems where the inlet static pressures are lower.

Figure 9:
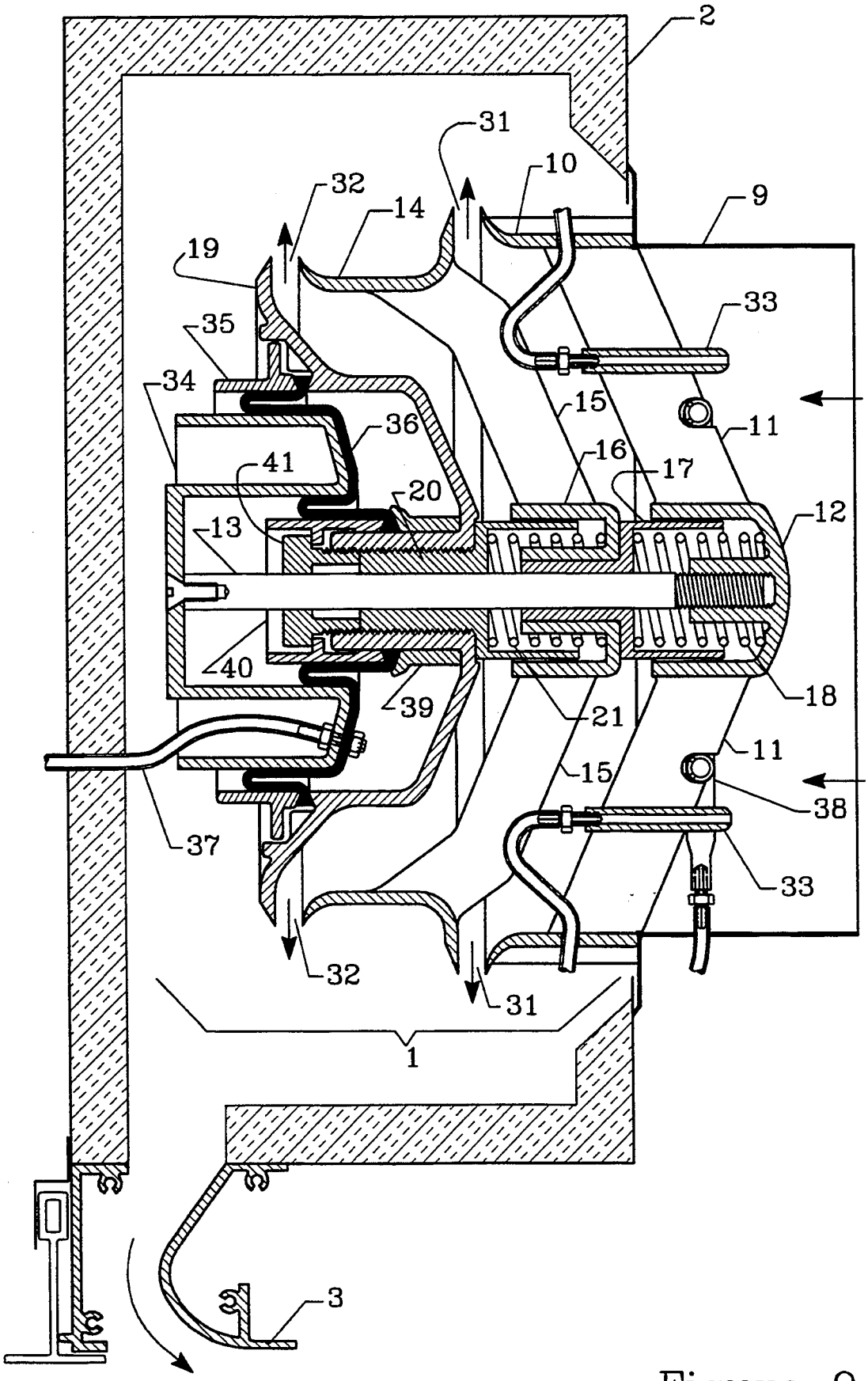
FIG. 9 is a section through a third embodiment of the invention which employs a pneumatic actuator instead of an electric motor.
Figure 11:
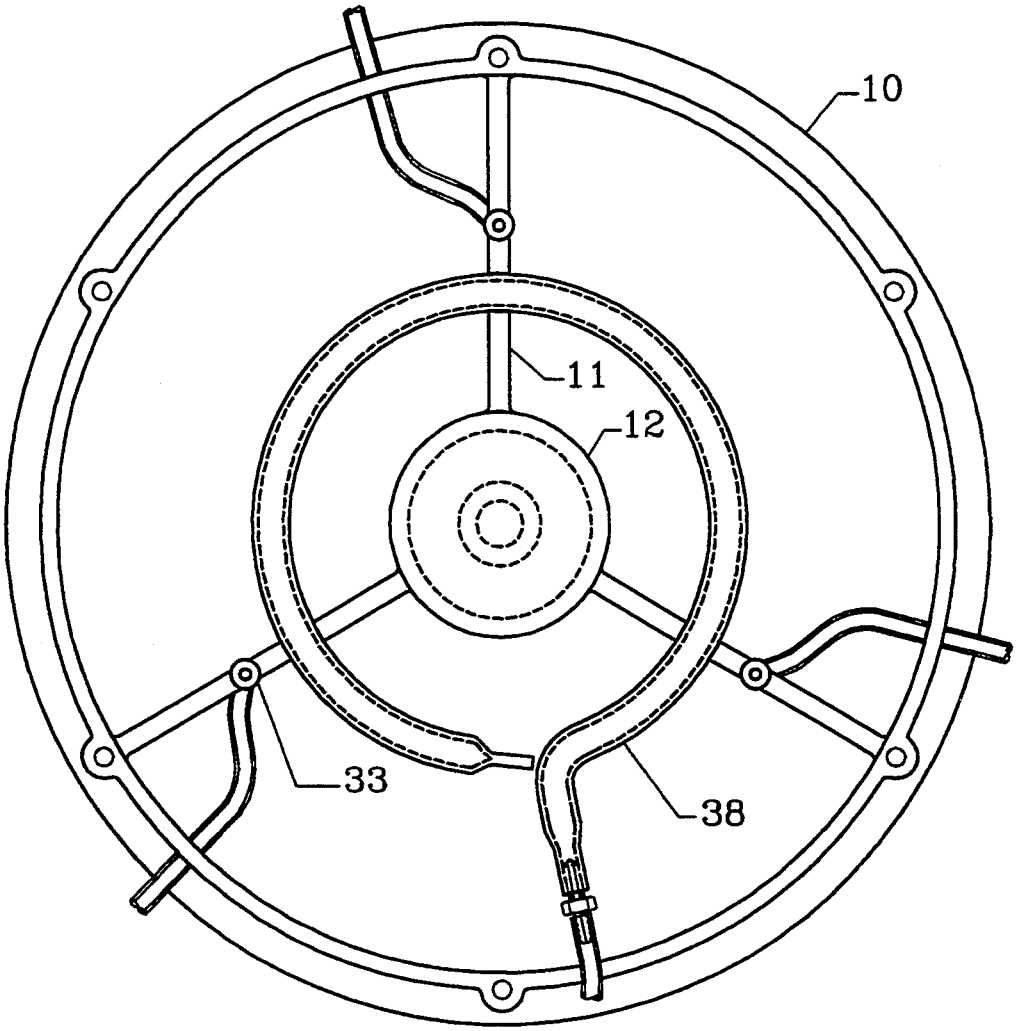
FIG. 11 is a front view of the inlet ring of the third and fourth embodiments of the invention with a static pressure probe attached.

Further, pneumatic actuation may be used instead of the electric motor to move the end plate relative to the inlet ring. A third embodiment of the invention is shown in FIG. 9. In reference to FIG. 9, a pneumatic piston 34 is rigidly attached to the downstream end of the main shaft 13. There is no external threading on the downstream end of the main shaft 13. In reference to FIG. 3, the motor and gear housing 22, the torque arm 27 and the torque shaft 28, and the rollers 29 are also omitted. In reference to FIG. 9, a ring shaped sleeve 35 is rigidly attached to the end plate 19 and together they form a pneumatic cylinder. A flexible diaphragm 36 seals the clearance between the piston 34 and the cylinder formed by the end plate 19 and the sleeve 35. The outer edge of the diaphragm 36 is compressed and held in place between the end plate 19 and the sleeve 35. The inner edge of the diaphragm 36 is compressed and held in place between two smaller sleeves 39, 40 which are secured to the end plate by a lock nut 41. This third embodiment is controlled by an industry standard, pressure independent pneumatic VAV box controller, also known as velocity controller, in conjunction with an industry standard pneumatic room thermostat. To provide a static pressure signal for the pneumatic VAV box controller, a static pressure probe 38, in the form of a ring shaped tube with a multiple of small holes drilled at selected locations to give a stable pressure signal, is pressed into slots in the spokes 11 of the inlet ring 10. FIG. 11 shows the front view of the inlet ring 10 with the static pressure probe 38 inserted in the slots of the spokes 11. One end of the static pressure probe is sealed, the other end is connected to the corresponding port on the pneumatic VAV box controller with pneumatic tubing. Similarly, the total pressure probes are connected to a corresponding port on the pneumatic VAV box controller. Electronic controllers are not used, and communications with a building automation system is not possible. The pneumatic VAV box controller receives a signal from the room thermostat, another signal from the total pressure probes from the total pressure probes 33 and a third signal from the static pressure probe 38, and generates a pneumatic output signal corresponding to a new valve setting. Upon increasing output signal value, the control air under pressure is admitted into the cylinder through a pneumatic tube 37, pushing the end plate 19 away from the piston 34, towards the inlet ring 10, resulting in reduced nozzle area. Reverse happens on a reduction in decreasing output signal value. The operating principle and method are similar to those of the first embodiment.

Figure 10:
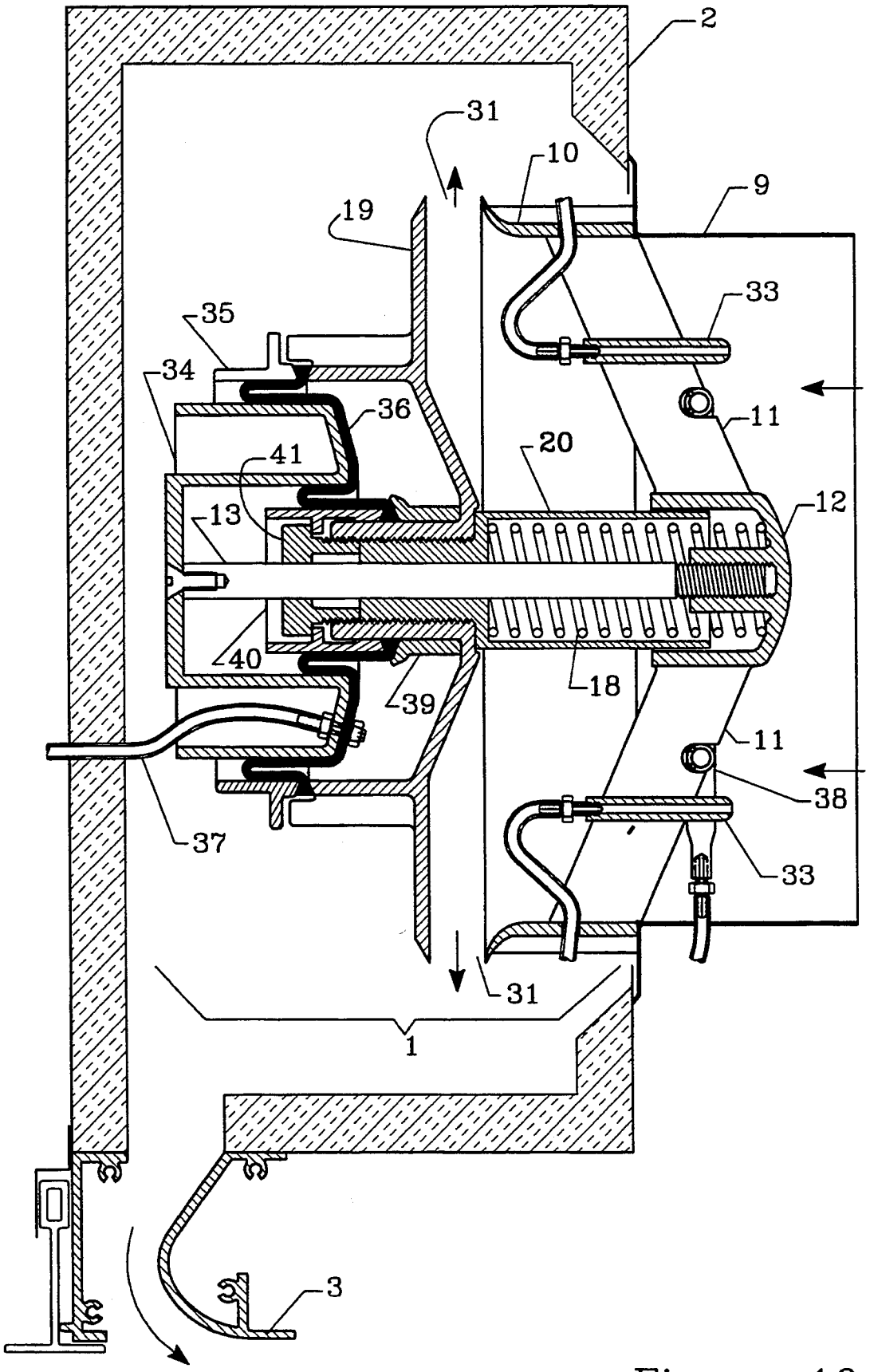
FIG. 10 is a section through a fourth embodiment of the invention which employs pneumatic actuation as in the third embodiment but the middle ring is omitted to save cost.

A fourth embodiment of the invention is shown in FIG. 10. The fourth embodiment employs pneumatic actuation as described above for the third embodiment, and further omits, in reference to FIG. 9, the middle ring 14, its sleeve 17 and one of the compression rings 21 to reduce manufacturing costs. The result of this modification is similar to that of the second embodiment, as described earlier.

The inlet and middle rings, and the end plate can be manufactured of preferably die cast or permanent mold cast aluminum or zinc alloy, or may be injection molded of a suitable plastic. All other parts can be manufactured of any suitable material and process.

The present invention has been shown and described with respect to four exemplary embodiments. However, other embodiments based on the principles of file present invention should occur to those of ordinary skill in the art. Such embodiments are intended to be covered by the claims.

I claim:

1. A variable volume air valve for adjusting supply air volume to a room in an air conditioning air system, comprising:

an acoustically lined plenum for direct attachment to a supply air terminal;

a duct collar rigidly attached to the plenum and connected to a supply air duct via a duct branch;

an inlet ring comprising an annular body, a minimum of two spokes and a hub, wherein one end of the inlet ring is connected to the duct collar to receive conditioned air, the other end opens into the plenum with a radially curved rim;

a main shall with the upstream end with respect to the direction of air flow coaxially aligned with the inlet ring and attached to the hub of the inlet ring;

an end plate, supported by the main shaft, whereby an annular nozzle is formed between the rims of the end plate and the inlet ring;

a compression spring located between the inlet ring and the end plate, the centerline of the compression spring being coaxial with the main shaft;

means for moving the end plate axially along the main shaft towards or away from the inlet ring, thereby respectively decreasing or increasing the area of the annular nozzle; and means for controlling the end plate moving means in response to a room thermostat.

2. An apparatus as defined in claim 1, further comprising:

an additional compression spring, located coaxially with the main shaft, between the first compression spring and the end plate;

a middle ring with an annular body, a hub and a minimum of two spokes, located on the main shaft between the inlet ring and the end plate and between the two compression springs, free to slide along the main shaft and held in position by the two opposing compression springs, with the rims of the middle ring at both ends curved radially away from the axis so that a first annular nozzle is formed between the curved rims of the inlet ring and the middle ring, and a second annular nozzle is formed between the curved rims of the middle ring and the end plate; and a sleeve made of a low friction material, inserted into the hub of the middle ring.

3. An apparatus as defined in claim 1, whereas the means for moving the end plate axially along the main shaft towards or away from the inlet ring comprises:

a screw threading on the downstream end of the main shaft with respect to the direction of air flow;

a torque arm with one end attached to the downstream end of the shaft, and the other end supporting a shorter torque shaft which is rigidly attached to the torque arm and is parallel to the main shaft; and a motor and gearbox housing, attached rigidly to the end plate, including a minimum of two rollers rotatably attached to the motor and gear housing and are in contact with the torque shaft to prevent the rotation of the end plate about the main shaft axis, an electric motor, a reduction gear train, and a captive nut which when rotated by the electric motor, drives the end plate back and forth along the main shaft, depending on the direction of rotation.

4. An apparatus as defined in claim 1, whereas the means for controlling the end plate moving means comprises:

an electronic room thermostat, located in a suitable location in a room, sending a signal corresponding to the room temperature, and an error signal corresponding to the difference between its set point and the actual room temperature, where the set point is adjustable and can also be reset by a building automation system;

pressure sensing means, for sensing differential pressure between the inlet of the air valve and a neutral point within the plenum, downstream of the annular nozzle, and providing a pressure signal indicative of air flow velocity through the annular nozzle;

an electronic controller, mounted in a box in a close proximity of the plenum, comprising at least one microcontroller to receive the signals from the room thermostat, compare the error signal with a previously received error signal and calculate the error change, receive a signal from the pressure sensing means, calculate a new desired air flow rate, and activate the end plate moving means to adjust the nozzle area until the desired air flow rate is attained;

means for storing operating sequence, operating parameters, including maximum and minimum allowable air flow rates and operator assigned variable volume air valve and room thermostat identification numbers, which may be input from the building automation system or through a portable computer plugged into the thermostat; and a communication means for connecting the room thermostat and the electrode controller to each other and to other thermostats and electrode controllers and to a building automation system.

5. An apparatus as defined in claim 4, wherein the electronic controller further comprises a supply air temperature sensor and means for switching from cooling mode to heating mode and back, depending on the signals received from the electronic room thermostat and the supply air temperature sensor, so that the electronic controller operates in cooling mode when the supply air temperature is lower than the room temperature, decreasing the supply air volume if the room temperature is cooler than the thermostat set point, and the electronic controller operates in heating mode when the supply temperature is higher than room temperature, increasing the supply air volume if the room temperature is cooler than the thermostat set point.

6. An apparatus as defined in claim 5, wherein the electronic controller further comprises means for controlling a reheat or perimeter heating system when the room thermostat cannot be satisfied by adjusting the supply air volume alone.

7. An apparatus as defined in claim 2, whereas the means for moving the end plate axially along the main shaft towards or away from the inlet ring comprises:

a screw threading on the downstream end of the main shaft with respect to the direction of air flow;

a torque arm with one end attached to the downstream end of the shaft, and the other end supporting a shorter torque shaft which is rigidly attached to the torque arm and is parallel to the main shaft; and a motor and gearbox housing, attached rigidly to the end plate, including a minimum of two rollers rotatably attached to the motor and gear housing and are in contact with the torque shaft to prevent the rotation of the end plate about the main shaft axis, an electric motor, a reduction gear train, and a captive nut which when rotated by the electric motor, drives the end plate back and forth along the main shaft, depending on the direction of rotation.

8. An apparatus as defined in claim 2, whereas the means for controlling the end plate moving means comprises:

an electronic room thermostat, located in a suitable location in a room, sending a signal corresponding to the room temperature, and an error signal corresponding to the difference between its set point and the actual room temperature, where the set point is adjustable and can also be reset by a building automation system;

pressure sensing means, for sensing differential pressure between the inlet of the air valve and a neutral point within the plenum, downstream of the annular nozzles, and providing a pressure signal indicative of air flow velocity through the annular nozzles;

an electronic controller, mounted in a box in a close proximity of the plenum, comprising at least one microcontroller to receive the signals from the room thermostat, compare the error signal with a previously received error signal and calculate the error change, receive a signal from the pressure sensing means, calculate a new desired air flow rate, and activate the end plate moving means to adjust the nozzle area until the desired air flow rate is attained:

means for storing operating sequence, operating parameters, including maximum and minimum allowable air flow rates and operator assigned variable volume air valve and room thermostat identification numbers, which may be input from the building automation system or through a portable computer plugged into the thermostat; and a communication means for connecting the room thermostat and the electronic controller to each other and to other thermostats and electronic controllers and to a building automation system.

9. An apparatus as defined in claim 8, wherein the electronic controller further comprises a supply air temperature sensor and means for switching from cooling mode to heating mode and back, depending on the signals received from the electronic room thermostat and the supply air temperature sensor, so that the electronic controller operates in cooling mode when the supply air temperature is lower than the room temperature, decreasing the supply air volume if the room temperature is cooler than the thermostat set point, and the electronic controller operates in heating mode when the supply temperature is higher than room temperature, increasing the supply air volume if the room temperature is cooler than the thermostat set point.

10. An apparatus as defined in claim 9, wherein the electronic controller further comprises means for controlling a reheat or perimeter heating system when the room thermostat cannot be satisfied by adjusting the supply air volume alone.

11. An apparatus as defined in claim 1, whereas the means for moving the end plate axially along the main shaft towards or away from the inlet ring comprises:

a pneumatic piston rigidly attached to the downstream end of the main shaft;

a pneumatic cylinder, formed by the end plate and a sleeve attached to the end plate;

a flexible diaphragm, sealing the clearance between the cylinder and the piston; and a nipple and pneumatic tubing attached to the piston for admission of control air from a pneumatic controller.

12. An apparatus as defined in claim 2, whereas the means for moving the end plate axially along the main shaft towards or away from the inlet ring comprises:

a pneumatic piston rigidly attached to the downstream end of the main shaft;

a pneumatic cylinder, formed by the end plate and a sleeve attached to the end plate;

a flexible diaphragm, sealing the clearance between the cylinder and the piston; and a nipple and pneumatic tubing attached to the piston for admission of control air from a pneumatic controller.

13. A variable air valve for installation in an acoustically lined plenum which may be directly mounted on a supply air terminal, the variable air valve comprising:

an inlet collar attached to the plenum and connected to a supply air duct; an inlet ring comprising an annular body, a minimum of two spokes and a hub, wherein one end of the inlet ring is connected to the duct collar to receive conditioned air, the other end opens into the plenum with a radially curved rim;

a main shaft with one end coaxially and rigidly attached to the hub of the inlet ring;

an end plate, supported by the main shaft;

an annular converging nozzle formed between the rims of the end plate and the inlet ring through which air flows into the plenum in a radial direction relative to the centerline of the duct collar, whereby pressure reduction and volume control is achieved by adjusting the width, thus the area of the nozzle, allowing the air to attain a maximum velocity determined by the differential pressure between the inlet of the air valve and the plenum, and by allowing the high velocity air stream entrain surrounding air and slow down and by dissipating the energy of the lower velocity air stream through friction with acoustically lined plenum walls; and means for moving the end plate axially along the main shaft towards or away from the inlet ring, thereby respectively decreasing or increasing the nozzle area and adjusting the air volume supplied to a room in response to a room thermostat.

* * * * *

UNITED STATES PATENT AND TRADEMARK OFFICE

CERTIFICATE OF CORRECTION

PATENT NO. : 5,373,987

DATED : December 20, 1994

INVENTOR(S) : Kaya Corabatir

It is certified that error appears in the above-indentified patent and that said Letters Patent is hereby corrected as shown below: ON THE TITLE PAGE:

Abstract, 10th line from the bottom, word "tile" should read "the".

Abstract, 7th line from the bottom, word "tiffs" should read "this".

Column 1, line 11, word "tile" should read "the".

Column 1, line 52, word "lifts" should read "this".

Column 2, line 12, word "al" should read "at".

Column 5, line 4, word "liar" should read "for".

Column 6, line 50, word "tiffs" should read "this".

Column 7, line 59, word "file" should read "the".

Column 8, line 8, word "shall" should read "shaft".

Column 9, line 28, word "electrode" should read "electronic".

UNITED STATES PATENT AND TRADEMARK OFFICE

CERTIFICATE OF CORRECTION

PATENT NO. : 5,373,987

DATED : December 20, 1994

INVENTOR(S) : Kaya Corabatir

It is certified that error appears in the above-indentified patent and that said Letters Patent is hereby corrected as shown below:

Column 9, line 29, word "electrode" should read "electronic".

Signed and Sealed this

Twenty-first Day of March, 1995

*Attest:*

Bruce Lehman

BRUCE LEHMAN

*Attesting Officer*

*Commissioner of Patents and Trademarks*